United States Patent [19]

Ohishi

[11] Patent Number: 4,500,620

[45] Date of Patent: Feb. 19, 1985

[54] ELECTROPHOTOGRAPHIC ELEMENT WITH COPOLYMER INTERLAYER

[75] Inventor: Chikashi Ohishi, Shizuoka, Japan

[73] Assignee: Fuji Photo Film Co., Ltd., Kanagawa, Japan

[21] Appl. No.: 513,587

[22] Filed: Jul. 14, 1983

[30] Foreign Application Priority Data

Jul. 14, 1982 [JP] Japan ..... 57-121279

[51] Int. Cl.[3] ..... G03G 5/14

[52] U.S. Cl. ..... 430/60; 430/49; 430/62; 430/64

[58] Field of Search ..... 430/49, 60, 62, 64

[56] References Cited

U.S. PATENT DOCUMENTS

| | | | |
|---|---|---|---|
| 3,595,649 | 7/1971 | Shimizu et al. | 430/60 |
| 4,032,338 | 6/1977 | Gange | 430/64 X |
| 4,389,476 | 6/1983 | Whaler-Shaw et al. | 430/64 |

FOREIGN PATENT DOCUMENTS

| | | | |
|---|---|---|---|
| 54-14805 | 2/1979 | Japan | 430/49 |
| 57-89760 | 6/1982 | Japan | 430/64 |
| 540251 | 12/1975 | U.S.S.R. | 430/62 |

*Primary Examiner*—Roland E. Martin

*Attorney, Agent, or Firm*—Sughrue, Mion, Zinn, Macpeak and Seas

[57] ABSTRACT

An electrophotographic lithographic printing material comprised of a conductive support, an interlayer, and a photoconductive layer is disclosed. The conductive support is comprised of a conductive paper laminated with carbon-containing polyethylene on both surfaces thereof using, as the interlayer, a polymer having the constructing units shown by following formulae and an acid value of 10 to 100;

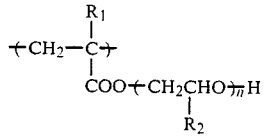

I wherein $R_1$ represents a hydrogen atom or a methyl group, $R_2$ represents a hydrogen atom, a methyl group, or an ethyl group; and n is an integer of 1 to 10,

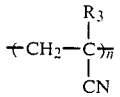

II wherein $R_3$ represents a hydrogen atom or a methyl group.

7 Claims, No Drawings

ELECTROPHOTOGRAPHIC ELEMENT WITH COPOLYMER INTERLAYER

FIELD OF THE INVENTION

This invention relates to an electrophotographic light-sensitive material and, more particularly, to an electrophotographic light-sensitive material having an improved interlayer between a conductive support and a photoconductive layer using zinc oxide, which is particularly suitable for making a lithographic printing plate.

BACKGROUND OF THE INVENTION

An electrophotographic light-sensitive material (zinc oxide light-sensitive plate) comprising a conductive support having a photoconductive layer composed of zinc oxide and a resin binder formed directly or through an interlayer having an electric resistance to some extent on the support has been frequently used. The conductive support used in the foregoing case may be a metal plate, a paper subjected to a conductive treatment, NESA glass (conductive transparent glass), an aluminum-vapor deposited plastic sheet or an aluminum laminated paper. However, when using an electrophotographic light-sensitive material using zinc oxide for a lithographic printing plate having high printing resistance, a conductivity-imparted paper both surfaces of which are laminated by polyethylene containing 5 to 25% carbon at a thickness of 10 to 45 μm is preferred in view of cost, easiness of handling and dimensional stability of the support during printing.

The photoconductive layer may be a layer of a dispersion of fine powder of zinc oxide in a resin binder such as shellac, paraffin, a vinyl resin, an acryl resin, a silicone resin, a phenol resin. Also, as the interlayer, a layer of polyvinyl alcohol, casein, carboxyl methyl cellulose, gum arabic, polyamide, polyester, etc. is employed.

For an electrophotographic lithographic printing material, a conductivity-imparted paper is most generally used as the support thereof but when using such a support, the printing durability is usually 2,000 to 3,000 prints and also the support extends 1 to 2% of the original length by the action of a fountain or dampening solution used for lithographic printing. Accordingly, the development of electrophotographic lithographic light-sensitive materials which have a high printing durability of 10,000 to 20,000 prints with good accuracy and are prepared at a cost not so much higher than that of conventional light-sensitive materials has been desired.

The inventors previously proposed a support composed of a conductivity-imparted paper having laminated on both surfaces thereof, polyethylene containing a conductivity-imparting agent such as carbon, etc., as shown in Japanese Patent Application 156829/81 (U.S. application Ser. No. 427,037). The support works well. However, under some conditions, the photoconductive layer partially peeled from the support.

SUMMARY OF THE INVENTION

As a result of further investigations into obtaining an electrophotographic light-sensitive material, in particular, an electrophotographic lithographic printing material using the foregoing support without the faults described above, the inventors have discovered that the aforesaid object can be attained by using a polymer (a)

having the constitutional units shown by following formulae I and II as the main component for the interlayer;

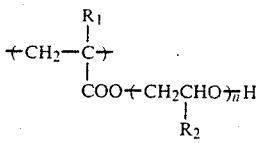

I wherein $R_1$ represents a hydrogen atom or a methyl group; $R_2$ represents a hydrogen atom, a methyl group, an ethyl group, or a chloromethyl group, preferably represents a hydrogen atom or a methyl group; and n represents an integer of 1 to 10, preferably 1 to 3.

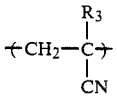

II wherein $R_3$ represents a hydrogen atom or a methyl group, and an acid value of 10 to 100, and based on the discovery, the invention has been attained.

That is, according to this invention, there is provided an electrophotographic light-sensitive material comprising a conductive support having formed thereon an interlayer and a photoconductive layer, said interlayer comprising the polymer (a) having the constitutional units shown by the foregoing formulae I and II and having an acid value of 10 to 100.

DESCRIPTION OF THE PREFERRED EMBODIMENTS

In a preferred embodiment of this invention, a paper containing a conductivity imparting agent, both surfaces of which are laminated with polyethylene containing 5 to 25% carbon, having 10 to 45 μm of a thickness, is used as the support for the electrophotographic light-sensitive material although other supports may be, as a matter of course, used in this invention.

As the conductive support in this invention, conductive supports generally used for electrophotographic light-sensitive materials can be used but in particular, in the case of using the electrophotographic light-sensitive material for a lithographic printing plate, it is preferred to use a conductive support composed of a paper containing a conductivity imparting agent, both surfaces of which are laminated with polyethylene containing carbon as described above.

The conductivity imparting agent used in this invention includes a cationic surface surfactant, such as alkyl trimethyl ammonium salt, alkyl dimethyl ammonium salt, alkyldimethyl benzyl ammonium salt, etc., a polymeric conductive substance, such as polydimethyldiaryl ammonium chloride, polyvinyl benzyl trimethyl ammonium chloride, etc. and others. The conductivity imparting agent is coated on the support in an amount of 3 to 15 g, preferably 5 to 10 g based on 1 $m^2$ of both surfaces of the support.

The photoconductive layer used in this invention is a layer of a dispersion of fine powder of zinc oxide in a binder such as shellac, paraffin, a vinyl resin (e.g., polystyrene, etc.), an acryl resin (e.g., methylmethacrylate, octylmethacrylate, butylacrylate, butylmethacrylate, ethylmethacrylate, etc.), a silicone resin, a phenol resin, etc.

One of preferable binders is a copolymer comprising 35 molar % of methylmethacrylate, 45 molar % of octylmethacrylate and 20 molar % of styrene. The ratio of ZnO to the resin binder is 4 to 8, preferably 4.5 to 6.0. The photoconductive layer may contain a sensitizing dye, such as Rhodamine B, Fluoresceine, Bromphenol Blue, Rose Bengal, etc. The components composing the photoconductive layer are dispersed in a solvent, such as xylene, toluene, etc., to be coated on a support.

The polymer (a) having an acid value of 10 to 100 and having the constitutional unit shown by the foregoing general formula I and the constitutional unit shown by foregoing general formula II includes a compound shown by the following general formula III, that is, a ternary, quaternary, or other multi-component copolymer composed of acrylonitrile or methacrylonitrile, an $\alpha,\beta$-unsaturated carboxylic acid, and, if necessary, other addition polymerizable unsaturated compounds;

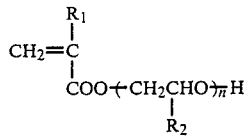

III wherein $R_1$, $R_2$, and n have the same significance as those in general formula I and a copolymer prepared by reacting a binary, ternary, or other multi-component copolymer composed of the compound shown by foregoing general formula III, acrylonitrile or methacrylonitrile, and, if necessary, other addition polymerizable compounds with a cyclic acid anhydride using an acid ester.

Typical examples of the $\alpha,\beta$-unsaturated carboxylic acid in this invention are acrylic acid, methacrylic acid, ethacrylic acid, maleic anhydride, methylmaleic anhydride, phenylmaleic anhydride, crotonic acid, cinnamic acid, itaconic acid, vinylbenzoic acid, sorbic acid, allylsulfonic acid, vinylsulfonic acid, vinylbenzenesulfonic acid, etc., and preferred examples thereof are acrylic acid, methacrylic acid, ethacrylic acid, etc.

The foregoing polymerizable unsaturated compounds are selected from those having one addition polymerizable unsaturated bond, and, for example, acrylic acid esters, acrylamides, methacrylic acid esters, methacrylamides, allyl compounds, vinyl ethers, vinyl esters, styrenes, crotonic acid esters, etc., and preferred examples thereof are acrylic acid esters, such as alkyl acrylate (e.g., methyl methacrylate, ethyl methacrylate, etc.).

Practical examples of the acrylic acid esters are alkyl acrylates (e.g., methyl acrylate, ethyl acrylate, propyl acrylate, butyl acrylate, amyl acrylate, ethylhexyl acrylate, octyl acrylate, t-octyl acrylate, chloroethyl acrylate, 2,2-dimethylhydroxypropyl acrylate, 5-hydroxypentyl acrylate, trimethylolpropane monoacrylate, pentaerythritol monoacrylate, glycidyl acrylate, benzyl acrylate, methoxybenzyl acrylate, furfuryl acrylate, tetrahydrofurfuryl acrylate, etc.), and aryl acrylates (e.g., phenyl acrylate, etc.), and preferred examples thereof are alkyl methacrylates, such as methyl methacrylate, ethyl methacrylate, octyl methacrylate, 2-hydroxyethyl methacrylate, etc.

Practical examples of the methacrylic esters are alkyl methacrylates (e.g., methyl methacrylate, ethyl methacrylate, propyl methacrylate, isopropyl methacrylate, amyl methacrylate, hexyl methacrylate, cyclohexyl methacrylate, benzyl methacrylate, chlorobenzyl methacrylate, octyl methacrylate, 4-hydroxybutyl methacrylate, 5-hydroxypentyl methacrylate, 2,2-dimethyl-3-hydroxypropyl methacrylate, trimethylolpropane monomethacrylate, pentaerythritol monomethacrylate, glycidyl methacrylate, furfuryl methacrylate, tetrahydrofurfuryl acrylate, etc.), and aryl methacrylates (e.g., phenyl methacrylate, cresyl methacrylate, naphthyl methacrylate, etc.).

Practical examples of the acrylamides are acrylamide, N-alkylacrylamides (examples of the alkyl group of the N-alkylacrylamide are, for example, a methyl group, an ethyl group, a propyl group, a butyl group, a t-butyl group, a heptyl group, an octyl group, a cyclohexyl group, a hydroxyethyl group, a benzyl group, etc.), N-arylacrylamides (examples of the aryl group are, for example, a phenyl group, a tolyl group, a nitrophenyl group, a naphthyl group, a hydroxyphenyl group, etc.), N,N-dialkylacrylamides (examples of the alkyl group are, for example, a methyl group, an ethyl group, a butyl group, an isobutyl group, an ethylhexyl group, a cyclohexyl group, etc.), N,N-diarylacrylamides (examples of the aryl group are, for example, a phenyl group, etc.), N-methyl-N-phenylacrylamide, N-hydroxyethyl-N-methylacrylamide, N-acetamidoethyl-N-acetylacrylamide, etc.

Practical examples of the methacrylamides are methacrylamide, N-alkylmethacrylamides (examples of the alkyl group are, for example, a methyl group, an ethyl group, a t-butyl group, an ethylhexyl group, a hydroxyethyl group, a cyclohexyl group, etc.), N-arylmethacrylamides (examples of the aryl group are a phenyl group, etc.), N,N-dialkylmethacrylamides (examples of the alkyl group are, for example, an ethyl group, a propyl group, a butyl group, etc.), N,N-diarylmethacrylamides (examples of the aryl group are, for example, a phenyl group, etc.), N-hydroxyethyl-N-methylmethacrylamide, N-methyl-N-phenylmethacrylamide, N-ethyl-N-phenylmethacrylamide, etc.

Practical examples of the allyl compounds are allyl esters (e.g., allyl acetate, allyl caproate, allyl carylate, allyl laurate, allyl palmitate, allyl stearate, allyl benzoate, allyl acetoneacetate, allyl lactate, etc.), allyoxy ethanol, etc.

Practical examples of the vinyl ethers are alkyl vinyl ethers (e.g., hexyl vinyl ether, octyl vinyl ether, decyl vinyl ether, ethylhexyl vinyl ether, methoxyethyl vinyl ether, ethoxyethyl vinyl ether, chloroethyl vinyl ether, 1-methyl-2,2-dimethylpropyl vinyl ether, 2-ethylbutyl vinyl ether, hydroxyethyl vinyl ether, diethyleneglycol vinyl ether, dimethylaminoethyl vinyl ether, diethylaminoethyl vinyl ether, butylaminoethyl vinyl ether, benzyl vinyl ether, tetrahydrofurfuryl vinyl ether, etc.), and vinyl aryl ethers (e.g., vinyl phenyl ether, vinyl tolyl ether, vinyl chlorophenyl ether, vinyl-2,4-dichlorophenyl ether, vinyl naphthyl ether, vinyl anthranyl ether, etc.).

Practical examples of the vinyl esters are vinyl butyrate, vinyl isobutyrate, vinyltrimethyl acetate, vinyldiethyl acetate, vinyl valerate, vinyl caproate, vinyl chloroacetate, vinyl dichloroacetate, vinylmethoxy acetate, vinylbutoxy acetate, vinylphenyl acetate, vinyl acetoacetate, vinyl lactate, vinyl-$\beta$-phenyl butyrate, vinylcyclohexyl carboxylate, vinyl benzoate, vinyl salicylate, vinyl chlorobenzoate, vinyl tetrachlorobenzoate, vinyl naphthoate, etc.

Practical examples of the styrenes are styrene, alkylstyrenes (e.g., methylstyrene, dimethylstyrene, trimethylstyrene, ethylstyrene, diethylstyrene, isopropylstyrene, butylstyrene, hexylstyrene, cyclohexylstyrene, decylstyrene, benzylstyrene, chloromethylstyrene, trifluoromethylstyrene, ethoxymethylstyrene, acetoxymethylstyrene, etc.), alkoxystyrenes (e.g., methoxystyrene, 4-methoxy-3-methylstyrene, dimethoxystyrene, etc.), halogenostyrenes (e.g., chlorostyrene, dichlorostyrene, trichlorostyrene, tetrachlorostyrene, pentachlorostyrene, bromostyrene, dibromostyrene, iodostyrene, fluorostyrene, trifluorostyrene, 2-bromo-4-trifluoromethylstyrene, 4-fluoro-3-trifluoromethylstyrene, etc.).

Practical examples of the crotonic acid esters are alkyl crotonates (e.g., butyl crotonate, hexyl crotonate, glycerol monocrotonate, etc.).

Other addition polymerizable unsaturated compounds used in this invention include dialkyl itaconates (e.g., dimethyl itaconate, diethyl itaconate, dibutyl itaconate, etc.) and dialkyl maleates and dialkyl fumarates (e.g., dimethyl maleate, dibutyl fumarate, etc.).

Furthermore, any other addition polymerizable unsaturated compounds polymerizable with the compound shown by foregoing general formula III and acrylonitrile or methacrylonitrile can be used. However, an addition polymerizable unsaturated compound having a functional group which reacts with the hydroxide of $\beta$-hydroxyethyl acrylate or methacrylate at room temperature and a polyfunctional addition polymerizable unsaturated compound having two or more polymerizable vinyl groups in one molecule are undesirable.

Useful cyclic acid anhydrides which are half-esterified to the copolymer of the compound of foregoing general formula III, acrylonitrile or methacrylonitrile, and, if necessary, other addition polymerizable unsaturated compound include phthalic anhydride, tetrahydrophthalic anhydride, hexahydrophthalic anhydride, 3,6-endomethylene-$\Delta^4$-tetrahydrophthalic anhydride, 3,6-endoxy-$\Delta^4$-tetrahydrophthalic anhydride, tetrachlorophthalic anhydride, maleic anhydride, chloromaleic anhydride, succinic anhydride, n-dodecylsuccinic anhydride, etc.

The acid value of the foregoing polymer is 10 to 100, preferably 15 to 40. If the acid value is higher than 100, there is a tendency to cause white spots (spot-like portions carrying no toner) at imaged areas when performing toner development, whereas if the acid value is lower than 10, there is a tendency to reduce the adhesion between the support and the interlayer.

The content of the constitutional unit of acrylonitrile or methacrylonitrile, that is, the constitutional unit shown by foregoing general formula II in the polymer (a) used in this invention is 5 to 60% by weight, preferably 10 to 40% by weight. Also, the content of the constitutional unit shown by foregoing general formula I is 30 to 80% by weight, preferably 40 to 60% by weight. If the contents of the constitutional units are outside these ranges, properties of the light-sensitive material are deteriorated with respect to one or more evaluation items such as the adhesion of the interlayer to the support, the occurrence of white spots at the imaged area, staining of non-imaged area (attachment of toner to non-imaged area), the attached amount of toner as imaged area, etc.

The coated amount of the interlayer is preferably 0.1 g/m$^2$ to 10 g/m$^2$, more preferably 1 g/m$^2$ to 4 g/m$^2$. If the amount is less than 0.1 g/m$^2$, the occurrence of white spots increases and if it is larger than 10 g/m$^2$, staining of the non-imaged area increases.

The invention will now be explained practically by the following examples but the invention is not limited by them in any way.

EXAMPLE 1

While heating 300 g of dioxane to 100° C. under nitrogen gas stream, a mixture of 150 g of 2-hydroxyethyl methacrylate, 60 g of acrylonitrile, 79.5 g of methyl methacrylate, 10.5 g of methacrylic acid, and 1.2 g of benzoyl peroxide was added dropwise to the dioxane over a period of 2 hours. After 15 minutes since the addition of the mixture was finished, 300 g of dioxane and 0.3 g of benzoyl peroxide were added to the mixture to perform the reaction for 4 hours under the condition. After the reaction was over, the reaction mixture was diluted with methanol and poured into water to precipitate a copolymer thus formed followed by vacuum drying at 70° C. to recover the copolymer. The acid value of the 2-hydroxyethyl methacrylate copolymer (1) thus obtained was 20.

After coating a wood free paper (density 100 g/m$^2$) support with an aqueous solution of 5% polyvinylbenzyltrimethyl ammonium chloride at a coverage of 20 g/m$^2$, the coated layer was dried to provide a conductivity-imparted paper. Then, after coating an aqueous latex of an ethylene-methyl acrylate-acrylic acid copolymer (65:30:5 by weight ratio) to both surfaces of the conductive support at a dry coverage of 0.2 g/m$^2$ followed by drying, pellets (melt index: 3) prepared by kneading a molten mixture of 85% polyethylene (density of 0.92, an average molecular weight of 22,000, and a softening point of 112° C.) and 15% conductive carbon were laminated on both surfaces of the support by an extrusion method as a thickness of 25 $\mu$m per one laminated layer to provide a conductive support. Then, the polyethylene laminate layer on one surface of the support was subjected to a corona discharge treatment under a condition of 5 KVA.sec./m$^2$ and a coating solution having the following composition was coated on the layer by means of a wire bar at a dry coverage of 1.5 g/m$^2$ followed by drying to form an interlayer.

| | |
|---|---|
| 2-Hydroxyethyl methacrylate copolymer (1) | 10 parts by weight |
| Methyl ethyl ketone | 60 parts by weight |
| Methyl cellosolve acetate | 30 parts by weight |

Then, a coating solution having the following composition was coated on the interlayer thus formed at a dry coverage of 20 g/m$^2$ followed by drying to form a photoconductive layer and thus to provide an electrophotographic lithographic printing material.

| | |
|---|---|
| Photoconductive zinc oxide (Sazex 2000, made by Sakai Kagaku Kogyo K.K.) | 100 parts by weight |
| Silicone resin (KR-2111, made by Shin-Etsu Chemical Co., Ltd.) | 35 parts by weight |
| Rose Bengale | 0.1 parts by weight |
| Fluoresceine | 0.2 parts by weight |
| Methanol | 10 parts by weight |
| Toluene | 150 parts by weight |

Using the electrophotographic lithographic printing material thus obtained, a printing plate was prepared by means of Itek 135 Type Printing Machine (made by Itek Corporation). The printing plate was subjected to a desensitization treatment with an etching solution (made by Addresso-Multigraphic Corp.) and printed on an offset press, Hamadastar 700 to provide 20,000 good prints.

EXAMPLE 2

A 2-hydroxyethyl methacrylate copolymer (2) was prepared by following the same procedure as in Example 1. The composition of the 2-hydroxyethyl methacrylate copolymer (2) was 2-hydroxyethyl methacrylate/acrylonitrile/methyl methacrylate/methacrylic acid of 60/10/27.5/2.5 by percent by weight. An electrophotographic lithographic printing material was prepared by following the same procedure as in Example 1 using the foregoing copolymer as a component for the interlayer and when a printing plate obtained from the printing material was printed on an offset press as in Example 1, 17,000 good prints were obtained.

While the invention has been described in detail and with reference to specific embodiments thereof, it will be apparent to one skilled in the art that various changes and modifications can be made therein without departing from the spirit and scope thereof.

What is claimed is:

1. An electrophotographic light-sensitive material, comprising:

a support base having a conductive surface, having formed thereon;

an interlayer; and a photoconductive layer formed on the interlayer;

said interlayer comprising a polymer having constitutional units represented by the following formulae I and II and having an acid value of 10 to 100 as the main component:

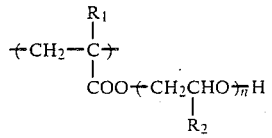

I wherein $R_1$ is a hydrogen atom or a methyl group; $R_2$ is a hydrogen atom, a methyl group, an ethyl group, or a chloromethyl group; and n is an integer of 1 to 10

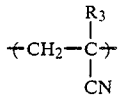

II wherein $R_3$ is a hydrogen atom or a methyl group, wherein the polymer includes constitutional unit II in an amount in the range of 5 to 60% by weight and the constitutional unit I in an amount in the range of 30 to 80% by weight, wherein the interlayer is present in an amount in the range of 0.1 g/m$^2$ to 10 g/m$^2$ and wherein both surfaces of the conductive support are laminated by polyethylene containing 5 to 25% carbon at a thickness of 10 to 45 μm.

2. An electrophotographic light-sensitive material as claimed in claim 1, wherein the conductive support is paper containing a conductivity imparting agent.

3. An electrophotographic light-sensitive material as claimed in claim 1, wherein both surfaces of the conductive support is laminated with polyethylene containing 5 to 25% carbon.

4. An electrophotographic light-sensitive material as claimed in claim 3, wherein the polyethylene containing 5 to 25% carbon is coated on both surfaces of the conductive support at a thickness in the range of 1.0 to 45 μm.

5. An electrophotographic light-sensitive material as claimed in claim 1, wherein the polymer has an acid value in the range of 15 to 40.

6. An electrophotographic light-sensitive material as claimed in claim 1, wherein the polymer includes the constitutional unit II in an amount in the range of 10 to 40% by weight and the constitutional unit I in an amount in the range of 40 to 60% by weight.

7. An electrophotographic light-sensitive material as claimed in claim 1, wherein the interlayer is present in an amount in the range of 1 g/m$^2$ to 4 g/m$^2$.

* * * * *